United States Patent [19]

Riemann

[11] Patent Number: 4,922,575

[45] Date of Patent: May 8, 1990

[54] THREE RIBBED TORQUE HANDLE

[76] Inventor: Herbert F. Riemann, 182 Guinea Rd., Cos Cob, Conn. 06807

[21] Appl. No.: 783,259

[22] Filed: Oct. 3, 1985

Related U.S. Application Data

[63] Continuation of Ser. No. 646,042, Mar. 30, 1984, abandoned, which is a continuation of Ser. No. 436,281, Oct. 25, 1982, abandoned.

[51] Int. Cl.[5] ..... B25G 1/10

[52] U.S. Cl. ..... 16/111 R; 16/DIG. 12; 16/DIG. 18; 81/177.3; 15/143 R

[58] Field of Search ..... 16/110 R, 111 R, DIG. 12, 16/DIG. 18, DIG. 19, DIG. 30; 81/177 R, 427.5, 489; 15/143 R, 145, 167 R; 294/57; D8/83, 107, 310, DIG. 3, DIG. 4; D23/28; D4/29, 30

[56] References Cited

U.S. PATENT DOCUMENTS

| | | | |
|---|---|---|---|
| D. 257,192 | 10/1980 | Moses | 16/111 R X |
| 1,839,835 | 1/1932 | Cook . | |
| 1,979,460 | 11/1934 | Forsberg . | |
| 3,343,577 | 9/1967 | Wagner . | |
| 3,463,209 | 8/1969 | Podolsky . | |
| 3,586,080 | 6/1971 | Slancy . | |
| 3,923,088 | 12/1975 | Arnn . | |

OTHER PUBLICATIONS

Basic Brushing American Dental Association, Chicago, IL 60611.

Smile Gram Smile Protection/ How to Brush and Floss Your Teeth Colgate Hoyt, Norwood, MA 02062.

Partners For Better Oral Hygiene, Procter & Gamble.

*Primary Examiner*—Nicholas P. Godici

*Assistant Examiner*—Michael William Starkweather

*Attorney, Agent, or Firm*—St. Onge Steward Johnston & Reens

[57] ABSTRACT

This invention relates to a rotational gripping device in the form of a torque handle which overcomes the problem of frictional slippage and provides mechanical rotational leverage. The handle includes a body portion having radially projecting rib members angularly displaced 120 degress about an axis of rotation. A rotational force is applied through the rib members by the user's hand and fingers. The rib member provide a positive no-slip drive. The torque handle is suitable for application to hand tools such as screw drivers, chisels, clamps, brushes, shovels, sports equipment such as rackets, baseball bats, golf clubs, boat oars and other similar implements.

17 Claims, 2 Drawing Sheets

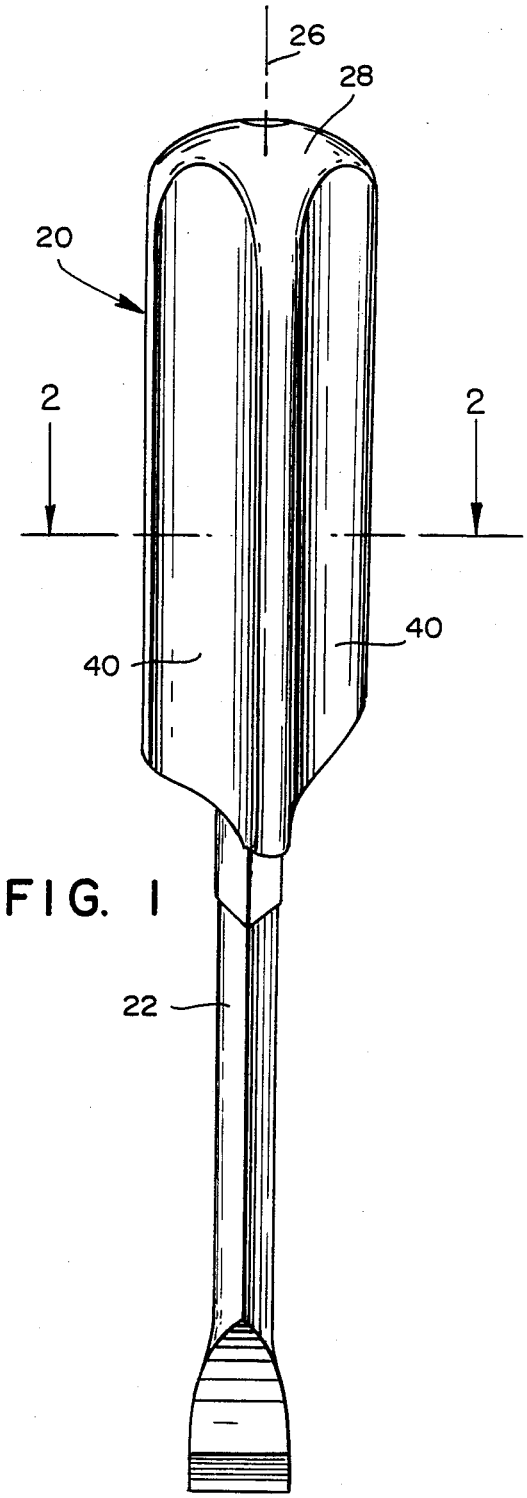
FIG. 1
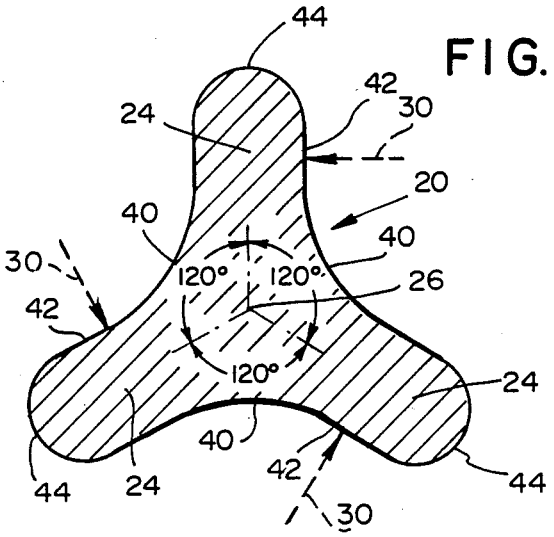
FIG. 2
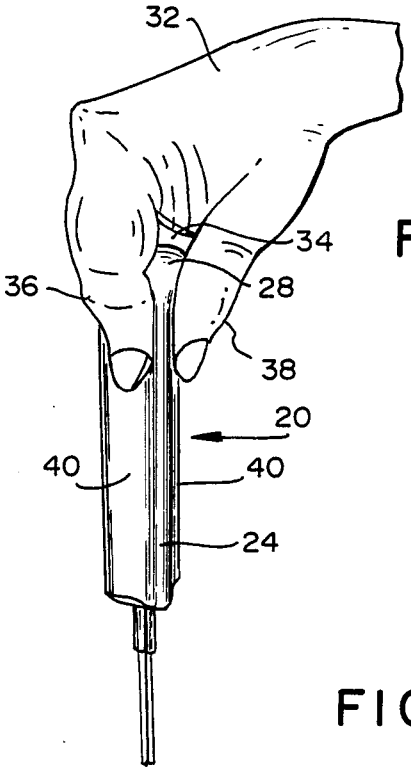
FIG. 3
FIG. 4
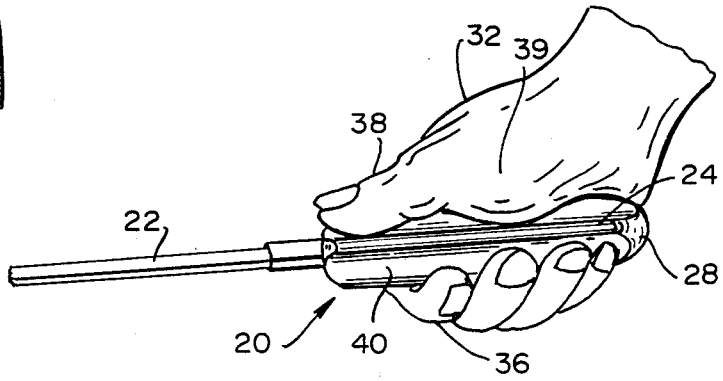

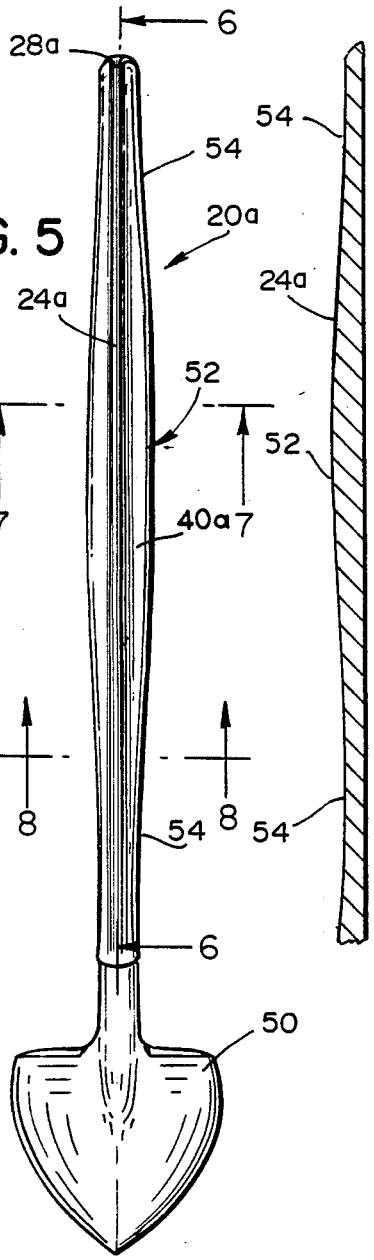
FIG. 5
FIG. 6
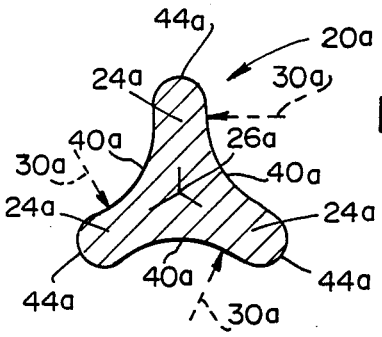
FIG. 7
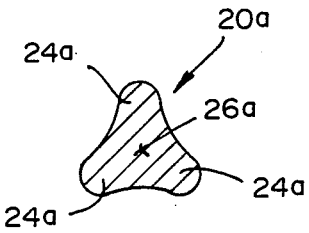
FIG. 8
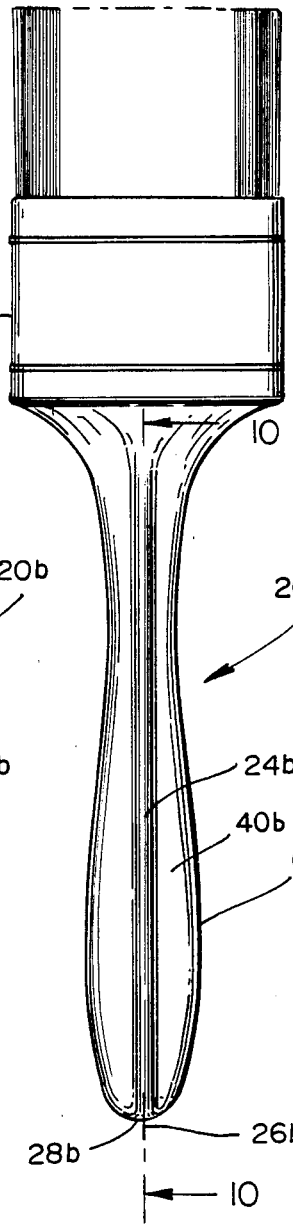
FIG. 9
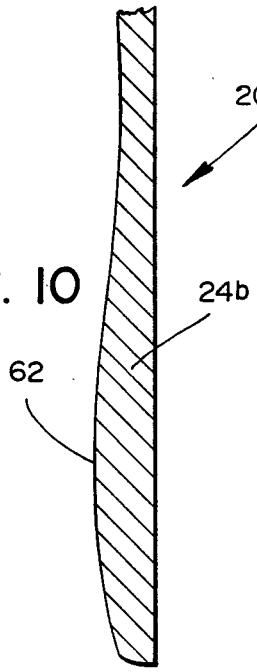
FIG. 10

THREE RIBBED TORQUE HANDLE

CROSS REFERENCE TO RELATED APPLICATION

This application is a continuation of application Ser. No. 646,042, filed Mar. 30, 1984, now abandoned, which is a continuation of application Ser. No. 436,281 filed Oct. 25, 1982, now abandoned.

TECHNICAL FIELD

This invention concerns rotational gripping devices and especially a torque handle.

In particular, the device of this invention relates to a purchase handle for applying torsional forces.

BACKGROUND ART

The evolution of handle designs for hand tools and other ansate implements included substantially cylindrical structures intended primarily for providing a comfortable hand grip. Generally, tool handles of the prior art such as those used for screwdrivers included a concave or reduced diameter portion adjacent the tool shank for receiving the user's thumb as typically shown in U.S. design patents nos. 143,931, 259,237, 261,610 and U.S. Pat. No. 3,586,080. In addition, some of those handles had a noncircular circumference so that the tool would not roll when placed on an inclined surface; similar handle designs were shown in U.S. design patents nos. 154,326 and 248,922.

A deficiency of the aforementioned tool handles was that they were not designed specifically for providing rotational leverage, as for driving a tool shaft. Another shortcoming of the prior art tool handles was that they relied upon a frictional gripping action. It should be apparent that the tenaciousness of the grasp was necessarily dependent upon the coefficient of friction between the material of which the handle was constructed and its surface configuration, as well as upon the muscular strength developed by the user's hand. Thus, the rotational driving force of a screwdriver, for instance, was diminished if the tool was being used by a mechanic having grease laden hands. Similarly, it should be appreciated that heavy gloves worn by a linesman or deep sea diver would affect the tool handle gripping action and the resultant torsional force applied. In a similar manner, the operation of hand tools and utensils of the prior art requiring a frictional force drive was severely limited when used by individuals having arthritic hand conditions.

The present invention overcomes the drawbacks of slippage inherent in the handles of the prior art and furthermore delivers rotational power through a gear drive principle.

DISCLOSURE OF THE INVENTION

Briefly, the nature of this invention involves a torque handle for providing mechanical advantage and improved gripping action.

The gist of the invention is directed to a handle structure for applying hand and finger generated forces tangentially with respect to a longitudinal axis of rotation and conversely for counterbalancing torsional forces resulting from angular displacement of a workpiece under load conditions. This is achieved by providing a handle body with a trilateral cross-section having hand and finger receiving surfaces.

A feature of this invention is that rotational leverage is achieved through the use of radial projections. A vector component of the applied manual force or couple is directed normal to the radial projection for producing a turning moment with the axis of rotation being perpendicular to the plane in which the turning moment acts.

It should therefore be obvious that in operation this handle does not depend upon clutching action for transmitting rotational forces as in the prior art but rather relies upon a no-slip drive principle. Another feature of this invention is that the user's hand and fingers provide a positive locking engagement with the handle and will thus not be readily subject to slippage.

A collateral advantage of the torque handle is that it substantially eliminates rubbing friction between the hand and handle thus preventing the formation of callouses and blisters. In addition, the torque handle is adapted to be held in multiple selected hand positions for inserting the tool into hard to reach places.

Furthermore, the handle generates rotational leverage through natural 120 degree wrist turns, with a hard drive or delicate use control. The moment arms substantially eliminate the need for grip strength; this feature is of particular benefit to users having physical disabilities, such as arthritis of the hand, fingers or wrist.

In view of the foregoing, it should be apparent that the present invention overcomes many of the disadvantages of the prior art and provides a torque handle which avoids many of the problems previously encountered in the prior art.

Having thus summarized the invention, it will be seen that it is an object thereof to provide a torque handle of the general character described herein which is not subject to the aforementioned deficiencies.

Specifically, it is an object of this invention to provide a torque handle for providing a no-slip positive drive.

Another object of the present invention is to provide a torque handle for counterbalancing load induced torsional forces.

Still another object of this invention is to provide a torque handle for applying turning force through radial member moment arms.

Yet another object of this invention is to provide a torque handle suitable for use in a wide range of hand implements.

An additional object of this invention is to provide a torque handle that is simple in construction, low in cost, reliable in use and well adapted for mass production fabrication techniques.

Other objects, features and advantages of the invention will in part be obvious and will in part be pointed out hereinafter.

With these ends in view, the invention finds embodiment in certain combinations of elements and arrangements of parts by which the objects aforementioned and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown possible exemplary embodiments of the invention:

FIG. 1 is a perspective view of a torque handle of this invention showing its application to a screwdriver;

FIG. 2 is a sectional view to an enlarged scale taken substantially along line 2—2 of FIG. 1 illustrating the trilateral handle structure;

FIG. 3 is a perspective view of the handle and a user's hand illustrating one gripping mode of applying rotational leverage;

FIG. 4 is a perspective view of the handle of this invention and a user's hand illustrating another mode for grasping the handle;

FIG. 5 is a perspective view of an alternate embodiment of a torque handle of this invention showing its application to a shovel;

FIG. 6 is a longitudinal sectional view taken substantially along line 6—6 of FIG. 5 illustrating the surface contour;

FIG. 7 is a sectional view to a slightly enlarged scale taken substantially along line 7—7 of FIG. 5 and showing the trilateral handle structure;

FIG. 8 is a sectional view to a slightly enlarged scale taken along line 8—8 of FIG. 5 and illustrating the trilateral handle structure;

FIG. 9 is a perspective view of a further embodiment of the torque handle of this invention showing its application to a brush; and FIG. 10 is a sectional view taken substantially along line 10—10 of FIG. 9 illustrating the surface contour.

BEST MODE FOR CARRYING OUT THE INVENTION

Referring now in detail to the drawings, the reference numeral 20 denotes generally a torque handle of this invention. The torque handle 20 as illustrated in FIG. 1 is shown in a typical application as applied to a screwdriver shaft 22. The handle 20 is preferably shaped from a section of wood stock although it can be manufactured of other suitable materials, e.g. formed from thermoplastic.

It should also be pointed out that, although the invention is described as applied to a screwdriver shaft 22 and in other applications hereinafter denoted, the torque handle 20 can be utilized in a wide range of other applications. For example, the torque handle 20 can be adapted for use on such hand tools as clamps, chisels, hand saws and similar ansate devices; additionally, it can be used as a modified handle for sports equipment including all forms of rackets, baseball bats, golf clubs, fencing foils, boat oars, etc.

Referring once again to the torque handle 20, it should be noted that the handle has a substantially uniform width and a triangular cross-sectional configuration as best shown in FIG. 2. The triangular body includes radially projecting rib members 24 spaced equilaterally about an axis of rotation 26. The length of the handle 20 in this typical embodiment is approximately 16 cm., which dimension has been found to extend substantially the length of an average hand grip span, as illustrated in FIG. 4. The maximum width dimension is about 4 cm., and the radial projections 24 are angularly spaced 120 degrees apart. The length dimension of the radial projection 24 from the axis of rotation 26 is about 2 cm. The aforementioned typical dimensions will, of course, vary and will be dependent upon the particular tool or hand implement to which the torque handle 20 is applied.

In the screwdriver embodiment illustrated, the screwdriver shaft 22 is secured to the torque handle 20 by providing a receiving bore (not shown) along the axis of rotation 26 for accommodating the shaft 22. An epoxy adhesive is utilized in order to effect a strong bonding action. It should also be noted that a rear portion 28 of the handle 20 is smoothly rounded as shown in FIG. 1.

Referring now to FIG. 2, it will be seen that each of the radial projections 24 provides a moment arm for generating a rotational leverage about the axis of rotation 26. A tangential force vector 30 acting perpendicular to the radial projection 24 causes a rotational displacement of the torque handle 20.

It should be apparent from FIG. 3 that the natural gripping action of a hand 32 will form a pocket 34 for receiving the rear end 28 of the handle 20 with the forefinger 36, thumb 38 and middle finger (not shown) resting in concave surface areas 40 which extend the length of handle 20. A twist action of the user's wrist will rotate the hand 32 and fingers 36, 38 through an angular displacement of approximately 120 degrees and will apply a finger generated force vector 30 normal to each radial projection 24. The finger grip can then be loosened and the hand repositioned to the initial position for again applying a rotational force.

In another mode of operation shown in FIG. 4, the hand 32 is placed along the handle 20 with the thumb 38 and the thumb pad 39 resting in concave areas 40. In addition, the forefinger 36 and remaining fingers surround one of the radial projections 24 and abut against another radial projection 24. The manner of applying a rotational force is similar to that previously described in that through the normal turning arc of the wrist and lower arm the hand 32 is rotated to approximately 120 degrees and a force vector 30 acts upon the radial projections 24. The hand 32 is then slid back to the initial position for the reapplication of the said force. In order to utilize the maximum tangential force vector 30, the side walls of the radial projection 24 are substantially parallel at a point of application 42. In addition, the end portion of each projection 24 has a curved nose at 44 so as to fit comfortably in the user's hand 32.

In a variant embodiment shown in FIGS. 5–8, the same reference numerals have been used for corresponding parts of this embodiment with respect to that previous described with the suffix "a". A shovel 50 is shown having a torque handle **20*a* which can be affixed by rivets or similar securement. The handle 20*a* has a trilateral configuration shown in FIG. 7 including a radial projection 24*a* spaced 120 degrees apart about an axis of rotation 26*a*. In all other respects, the projection 24*a* corresponds to that shown in FIG. 2; however, as shown in FIG. 6, a central waist portion 52 is of greater width dimension than at an upper and lower end 54. This can also be readily observed in reference to FIGS. 7 and 8. The reason for this configuration is that it has been found that in using the shovel a person generally positions his hands at the narrower portions corresponding to the upper and lower ends 54 (FIG. 8) which provides a more comfortable grip when the shovel 50 is used for lifting a load; however, when the shovel 50 is used for digging or under heavy load conditions, the user can slide his hand to the waist portion 52 for increased mechanical advantage. This is accomplished because the radial projections 24*a* are of greater length dimension from the axis of rotation 26*a*** and therefore will provide increased torsional force.

It should also be mentioned that under actual load conditions wherein the user is lifting material with the shovel, the torque handle **20*a*** provides a counterbalancing force to the torque which may be induced by the shovel loading.

Referring now to FIGS. 9 and 10, a modified embodiment is shown wherein the same reference numerals have been used for designated corresponding parts of the first descri bed embodiment with the addition of the suffix "b".

FIG. 9 shows a brush 60, such as a paint brush, having a modified torque handle **20*b*. The handle 20*b* includes three radial projections 24*b* spaced 120 degrees apart about an axis of rotation 26*b*. The surface contour of the handle as shown in FIG. 10 provides an enlarged width dimension in area 62** for providing increased mechanical advantage as hereinbefore described.

It should thus be seen that there is provided a torque handle which achieves the various objects of the invention and which is well adapted to meet the conditions of practical use.

Since various possible embodiments might be made of the present invention and various changes might be made in the exemplary embodiments set forth, it is to be understood that all material shown and described in the accompanying drawings is to be interpreted as illustrative and not in a limiting sense.

Having thus described the invention, there is claimed as new and desired to be secured by Letters Patent:

1. A hand tool comprising:

an elongate handle having an axis of rotation extending through its length, said handle having rib means projecting radially outwardly from said axis of rotation and extending along the length of said handle, said rib means consisting essentially of three ribs symmetrically spaced 120° apart, wherein each of said ribs is defined by a pair of walls which are substantially parallel and, wherein each pair of the ribs define between them a concave groove portion having a depth sufficient to receive a large portion of a finger or thumb for application of a force substantially entirely against and perpendicular to the walls of the ribs, thereby rotating said elongate handle about the axis of rotation; and a torque-driven implement having an elongate shaft with first and second ends, said shaft including a torque-driven tool at its first end with the second end of said shaft connected to and extending from said handle along a path colinear with the axis of rotation, whereby said torque-driven tool can be turned with increased torque compared to such tools with handles having shallower concave groove portions capable of only receiving a smaller portion of a finger or thumb and having more than three ribs, whereby said handle is grasped by inserting the thumb longitudinally in one of the concave groove portions and the tips of the fingers in another of the concave groove portions.

2. A hand tool according to claim 1, wherein said ribs project a maximum distance from the axis of rotation at selected locations along the length of the handle for increasing rotational leverage.

3. A hand tool according to claim 1, wherein the walls of each of said ribs unite at a point distal from the axis of rotation as a curved tip.

4. A hand tool according to claim 3, wherein each said concave portion has a curved surface.

5. A hand tool according to claim 1, wherein said torque-driven tool is a screw driver.

6. A hand tool according to claim 1, wherein said handle is made from wood.

7. A hand tool according to claim 1, wherein said handle is made from plastic.

8. A hand tool comprising:

an elongate handle having an axis of rotation extending through its length, said handle having rib means projecting radially outwardly from said axis of rotation, and extending along the length of said handle, said rib means consisting essentially of three ribs symmetrically spaced 120° apart, wherein each of said ribs is defined by a pair of walls which are substantially parallel and, wherein each pair of the ribs define between them a concave groove portion having a depth sufficient to receive a large portion of a finger or thumb for application of a force substantially entirely against and perpendicular to the walls of the ribs, thereby rotating said elongate handle about the axis of rotation, the length of said handle extending between a first end and a second end with said first end having a curved surface;

a torque-driven implement having an elongate shaft with first and second ends, said elongate shaft including a torque-driven tool at its first end with the second end of the shaft passing through the second end of the handle along a path colinear with the axis of rotation, whereby said torque-driven tool can be turned by hand with increased torque compared to such tools with handles having shallower concave groove portions receiving a smaller portion of a finger or thumb and having more than three ribs, and whereby said handle is grasped by inserting a thumb or finger longitudinally into each concave groove portion so that the palm of the hand engulfs the first end of said handle.

9. A hand tool according to claim 8, wherein said ribs project a maximum distance from the axis of rotation at selected locations along the length of the handle for increasing rotational leverage.

10. A hand tool according to claim 8, wherein the walls of each of said ribs unite at a point distal from the axis of rotation as a curved tip.

11. A hand tool according to claim 10, wherein each said concave portion has a curved surface.

12. A hand tool according to claim 8, wherein said torque-driven tool is a screw driver.

13. An elongate handle having an axis of rotation extending through its length and being suitable for use in combination with a torque-driven tool, said handle comprising:

rib means projecting radially outwardly from said axis of rotation and extending along the length of said handle, said rib means consisting essentially of three ribs symmetrically spaced 120° apart, wherein each of said ribs is defined by a pair of walls which are substantially parallel;

a concave groove portion between each pair of said ribs extending along the length of said handle and having a depth sufficient to receive a large portion of a thumb or finger for application of a force substantially entirely against and perpendicular to the walls of the ribs, thereby rotating said elongate handle about the axis of rotation;

means adapted to receive said torque-driven tool at an end of said handle along a path colinear with said axis of rotation, whereby a torque-driven tool fitted with said elongate handle can be turned with increased torque compared to such tools with handles having shallower concave groove portions capable of only receiving a smaller portion of a finger or thumb and having more than three ribs, and by whereby said handle is grasped inserting the thumb longitudinally in one of the concave groove portions and the tips of the fingers in another of the concave groove portions.

14. An elongate handle according to claim 13, further comprising:

a curved end distal from the end having the means to receive said torque-driven tool.

15. An elongate handle according to claim 13, wherein said ribs project a maximum distance from the axis of rotation at selected locations along the length of the handle for increasing rotational leverage.

16. An elongate handle according to claim 13, wherein the walls of each of said ribs unite at a point distal from the axis of rotation as a curved tip.

17. An elongate handle according to claim 16, wherein each said concave portion has a curved surface.

* * * * *